US008333622B2

(12) United States Patent
Blasko et al.

(10) Patent No.: US 8,333,622 B2
(45) Date of Patent: Dec. 18, 2012

(54) DUAL CONTACT BEAM TERMINAL

(75) Inventors: Raymond J. Blasko, Boardman, OH (US); Mark D. McCall, Hubbard, OH (US); Paul S. Lam, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 42 days.

(21) Appl. No.: 12/961,099

(22) Filed: Dec. 6, 2010

(65) Prior Publication Data

US 2012/0142233 A1 Jun. 7, 2012

(51) Int. Cl.
*H01R 11/22* (2006.01)

(52) U.S. Cl. ..... 439/852; 439/595

(58) Field of Classification Search ..... 439/852, 439/595, 357, 752.5
See application file for complete search history.

(56) References Cited

U.S. PATENT DOCUMENTS 4,838,816 A * 6/1989 Matsusaka et al. ..... 439/861
5,443,592 A * 8/1995 Ittah et al. ..... 439/851
5,839,925 A * 11/1998 Simmons ..... 439/852
6,244,910 B1 6/2001 Grubbs
6,290,553 B1 * 9/2001 Sato et al. ..... 439/843
6,520,811 B2 2/2003 Mitani et al.
6,547,608 B2 * 4/2003 Sato et al. ..... 439/852
6,692,316 B2 2/2004 Hsien
7,048,582 B2 * 5/2006 Tabata et al. ..... 439/595
7,094,081 B1 8/2006 Senk
7,682,191 B2 * 3/2010 Iwahori et al. ..... 439/595

* cited by examiner

*Primary Examiner* — Hien Vu
(74) *Attorney, Agent, or Firm* — Thomas N. Twomey

(57) ABSTRACT

A terminal is used in an electrical connector and receives a matable contact member. The terminal has a receptacle contact section has a bottom wall, an upper wall, and a primary and a secondary spring beam, or member. The primary member extends from a bottom wall and is bent back into the receptacle contact section. The primary member has an upper surface facing the upper wall and a lower surface opposite the upper surface. The primary member includes a free end that is spaced from the upper wall a distance less than a thickness of the matable contact member. The secondary member is formed from the bottom wall that extends into the contact section and includes a free end disposed beneath the lower surface of the primary member in an overlapping, spaced relationship thereto remote from the free end of the primary member.

10 Claims, 8 Drawing Sheets

DUAL CONTACT BEAM TERMINAL

TECHNICAL FIELD

This invention relates to a terminal used in an electrical connector.

BACKGROUND OF INVENTION

It is known to use stamped and formed box receptacle terminals or contacts in automotive electrical systems to establish contact with pins or blades extending from mating terminals housed in a connector or from a printed circuit board header.

Box receptacle contacts typically have upwardly formed sidewalls extending from a base of the contact and a top wall extending between the sidewalls to enclose a box receptacle portion of the contact. A spring is formed from the base typically in a form of a cantilever beam. When a mating contact is inserted into the box receptacle portion between the cantilever beam and the top wall, deflection of the cantilever beam generates a mating force. While the main contact point for the mating contact may be along the top wall of the box receptacle contact, deflection of the cantilever beam generates a sufficient contact force to establish a reliable connection between the receptacle terminal and the mating contact. In a vehicle wiring harness, a plurality of these box receptacle terminals receive a plurality of mating contacts. Increasingly, it is desirable to reduce the weight, or mass of the vehicle so that fuel economy of the vehicle may increase. Thus, decreasing the mass of a box contact/mating contact connection where a plurality of these connections are used subtracts mass from the vehicle. It also remains a desirable goal to maintain or improve the electrical connection between the box receptacle contact, or the receptacle contact section and the received mating contact.

Accordingly, a robust contact section terminal/mating contact connection is needed having decreased mass that also has reliable electrical operating performance.

SUMMARY OF THE INVENTION

One aspect of the invention is to provide a box receptacle terminal with a receptacle contact section having decreased mass. Another aspect of the invention is to provide a box terminal having decreased mass that also provides reliable electrical connection with a mating contact member received in the receptacle contact section. To this end, yet another aspect of the invention is the discovery of the interaction and optimization of a difference between a peak engage force and a sliding engage force associated with a mating contact member being received into the receptacle contact section and a permanent set of a primary and a secondary beam members being about the same to provide a terminal that embodies decreased mass having reliable electrical performance. Peak engage force is defined as the maximum insertion force at a point of contact between the mating contact member and the receptacle contact section to insert the mating contact member into the receptacle contact section. Sliding engage force is defined as a constant engagement force experienced after realization of the peak engage force when a constant cross section of the mating contact member slides through the receptacle contact section that completes the connection between the mating contact member and the receptacle contact section of the terminal. Permanent set is defined as the amount of deformation of the primary and secondary spring members, respectively, from an original neutral position after initial insertion of a mating contact member after the mating contact member has been disconnected and removed from the receptacle contact section.

Based on the desire to have a box receptacle terminal that embodies the characteristics of low mass, reliable electrical connection with a mating terminal where the difference of the peak engage force and the sliding engage force is a minimum, and a permanent set between the primary and secondary beam being about the same, and accordance to principles of the invention, a box receptacle terminal is presented for use in an electrical connector receiving the mating contact member, or terminal. The box terminal includes a receptacle contact section having a bottom wall and an upper wall and also includes a primary and a secondary cantilever spring member. The primary member extends from the bottom wall into a receptacle contact section. The primary member has reversely bent section having an upper surface facing the upper wall and a lower surface opposite the upper surface. The reversely bent section includes a free end and the free end is spaced from the upper wall a distance less than a thickness of the matable contact member. The secondary member is formed from the bottom wall that extends into the contact section and includes a free end. The free end of the secondary member is disposed beneath the lower surface of the primary member in an overlapping, spaced relationship thereto remote from the free end of the primary member.

In yet another embodiment of the invention, an electrical connection includes a first connector and a second connector that mates to the first connector. The first connector includes at least one receptacle that receives at least one receptacle contact section. The second connector includes at least one receptacle receiving that at least one mating contact member that mates to the at least on receptacle contact section. The at least one receptacle contact section includes bottom wall and an upper wall and also has a primary and a secondary spring member. The primary member extends from a forward end of the bottom wall being bent back into the at least one receptacle contact section. The primary member has an upper surface facing the upper wall and a lower surface opposite the upper surface. The free end of the primary member is spaced from the upper wall a distance less than a thickness of the matable contact member. The secondary member is formed from the bottom wall and extends into the contact section. The secondary member has a free end that is disposed beneath the lower surface of the primary member in an overlapping, spaced relationship thereto remote from the free end of the primary member.

BRIEF DESCRIPTION OF THE DRAWINGS

This invention will be further described with reference to the accompanying drawings in which.

DETAILED DESCRIPTION OF THE PREFERRED EMBODIMENTS

Figure 1:
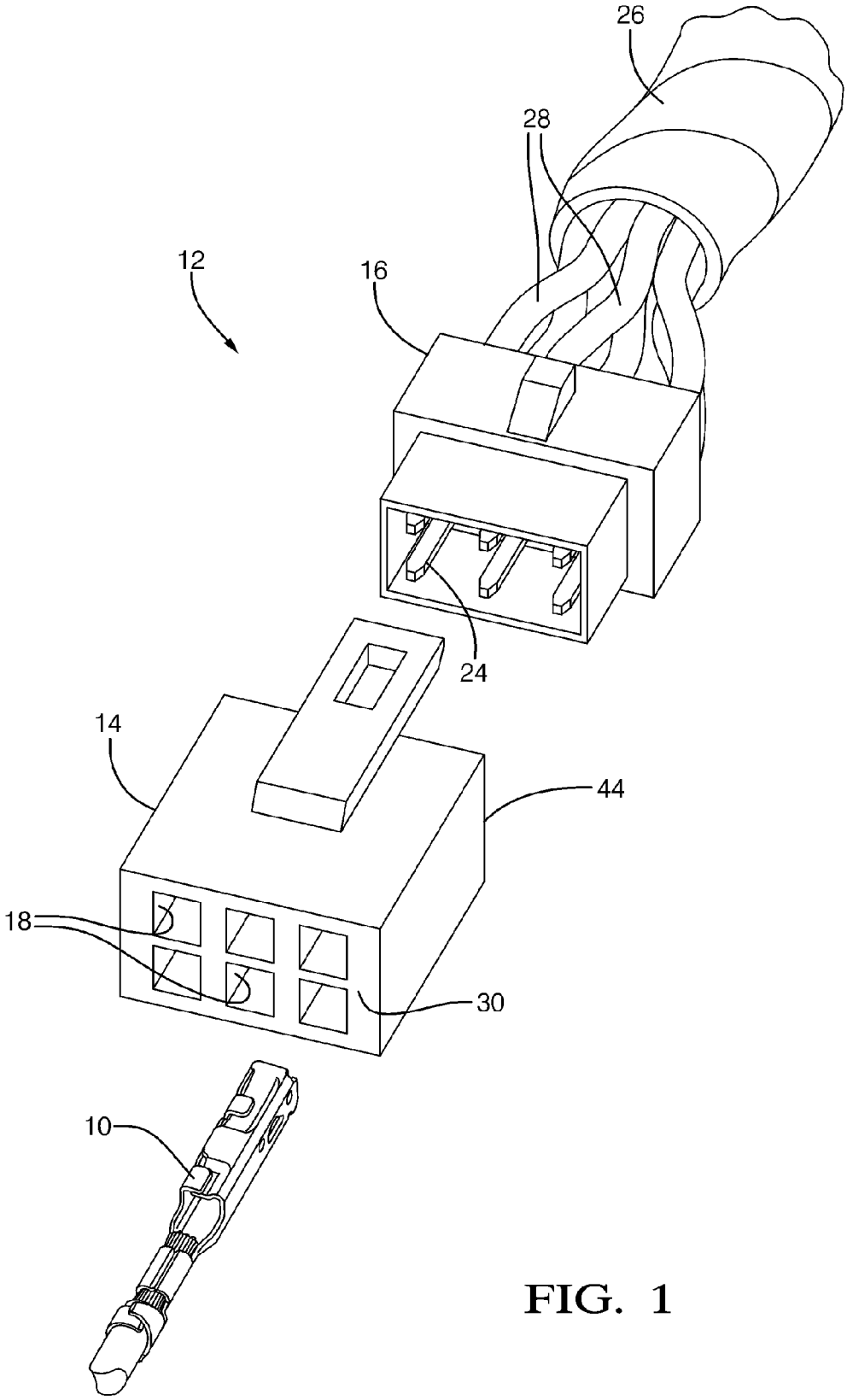
FIG. 1 shows a exploded isometric view of a connection system that employs a box receptacle terminal that includes a primary and a secondary spring contact beam in accordance with the invention, and the box receptacle terminal is received in a connector that receives a corresponding mating terminal disposed in a corresponding mating connector.

In accordance with a preferred embodiment of this invention, referring to FIG. 1, a box receptacle contact, or electrical terminal 10 is configured in a wire cable connection system 12 in a vehicle. For example, connection system 12 may be used to connect electrical signals together used to operate electrical components disposed in the vehicle.

Connection system 12 includes a pair of molded dielectric mating connector housings 14, 16. First connector housing 14 is a first, or socket connector and second connector housing 16 is a second, or plug connector that mates with socket connector 14. Socket connector 14 has a number of cavity positions 18. At least one position 18 in connector 14 receives at least one box terminal 10. Plug connector 16 has a number of cavity positions (not shown). At least one position in connector 16 includes a mating contact member, or mating male terminal 24 that corresponds with position 18 of connector 14 that includes box terminal 10 so that box terminal 10 receives at least one male terminal 24 when connectors 14, 16 are connected together. Box terminal 10 is a female-type terminal and the matable terminal is a male-type terminal 24. Male-type terminal 24 is a blade terminal. Alternately, the male-type terminal may have other terminal end configurations, such as a pin configuration, and the like. Connector 16 receives a wire bundle, or cable 26 having a plurality of wire conductors 28 that terminate at connecter 16. Connector housing 14, including box terminal 10, receives a wire cable (not shown) having wire conductors 29 that terminate at housing 14 similar to that shown with connector 16. Alternately, at least one of the connectors may interface to a printed circuit board (PCB) header connecter (not shown).

In one embodiment, box terminal 10 herein recited is intended to mate with male blade terminal 24 having an approximate width of 1.5 millimeters and 2.8 millimeters. These terminal widths are two of the many number of standard blade terminal widths used in automotive electrical wiring connection systems. Alternately, other blade widths may be used for box terminal 10 and blade terminal 24. These terminal widths have been adopted as a standard by a variety of organizations, such as United States Council for Automotive Research (USCAR). The lengths of box terminal 10 and blade terminal 24 may have various lengths depending on the geometries of the terminals and the application of use in a vehicle.

Referring to FIGS. 1-10, terminals 10, 24 are formed of a stamped and formed electrically conductive material, such as copper alloy. In one embodiment, the amount of copper may be 70-98% of the composition of the material. Additional metals, like nickel, tin, and silicon may be added to enhance the strength of terminals 10, 24. Alternately, the male and female terminals may have an electroplated material applied to their external surface to further enhance electrical conductivity between these mated terminals, and the electroplated material may be bright tin or gold plating, and the like. Box terminal 10 is inserted by being pushed, or urged into position 18 from a rear end 30 of connector 14. A flexible portion 32 in connector 14 deflects upon insertion of terminal 10 into position 18. When box terminal 10 is fully inserted, or seated, in position 18, flexible portion 32 returns to about its original normal position after being flexed to engage first shoulder 34 of connector 14 to retain box terminal 10 in position 18. A cavity index 36 is formed in a bottom wall, or receptacle base 38 of box terminal 10 and is in communication with a second shoulder 40 of connector 14 that assist to prevent box terminal 10 from being inserted upside down, or in a wrong orientation in housing 14. Receptacle base is generally parallel with axis A. Cavity index 36 is keyed to a channel (not shown) defined in cavity positions 18 in connector 14 that communicates with shoulder 40 in housing 14 so that box terminal 10 is received into cavity 18 in a single axial insertion orientation. Although box terminal 10 is keyed to a single axial orientation in connector 14, other alternate orientations are possible with a connector keyed to these other specific orientations. A terminal position assurance member 37 may be inserted behind box terminal 10 through rear end 30 of connector 14 into cavities 18 so that box terminal 10 does not inadvertently become dislodged from flexible portion 32 of connector 14. Male terminals 24 are inserted into connector 16 in a manner similar to box terminals 10 in connector 14, as previously described herein.

Figure 2:
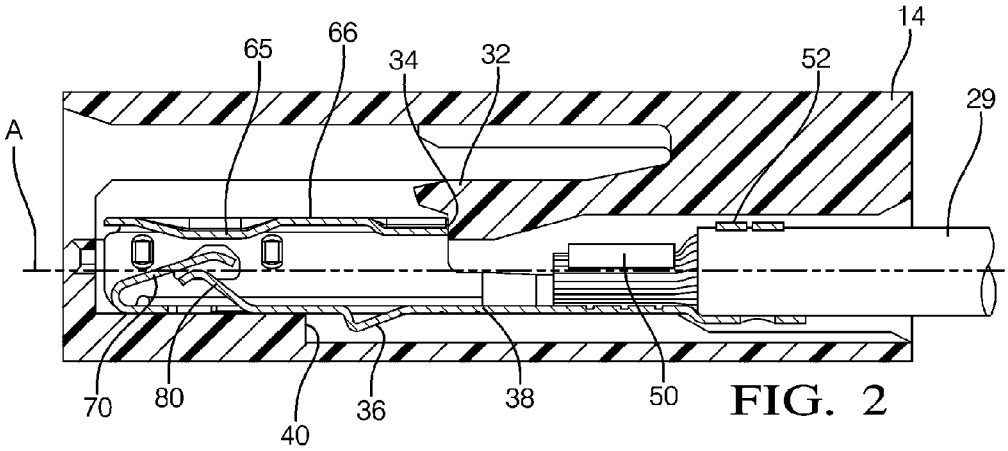
FIG. 2 shows a cross section view of the box receptacle terminal in the neutral position disposed in one of the connectors of the connection system of FIG. 1.
Figure 3:
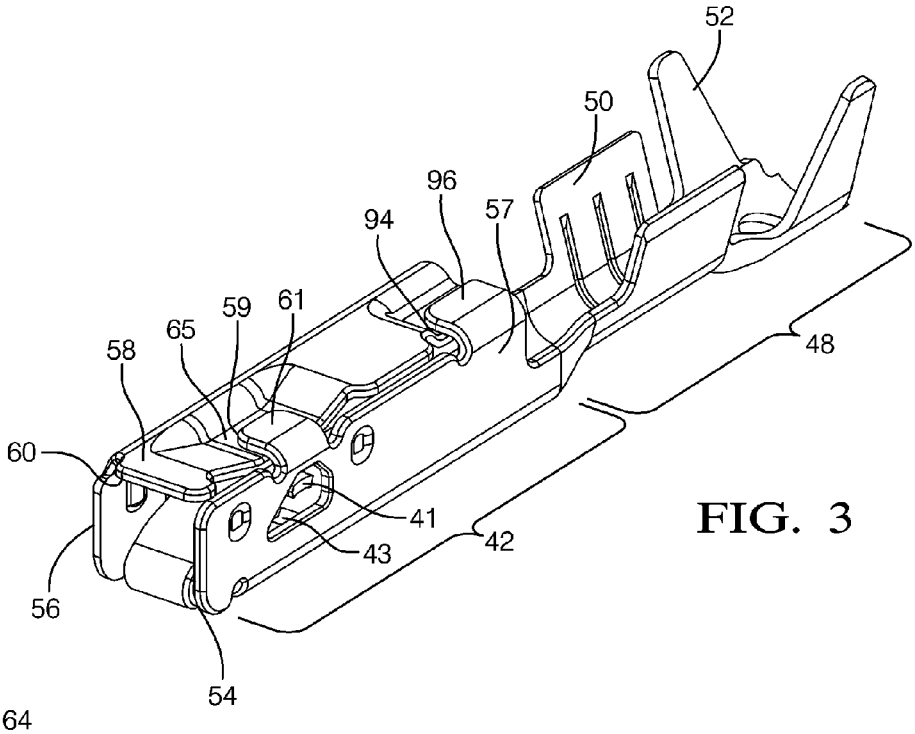
FIG. 3 shows a left-side isometric view of the box receptacle terminal of FIG. 1.
Figure 4:
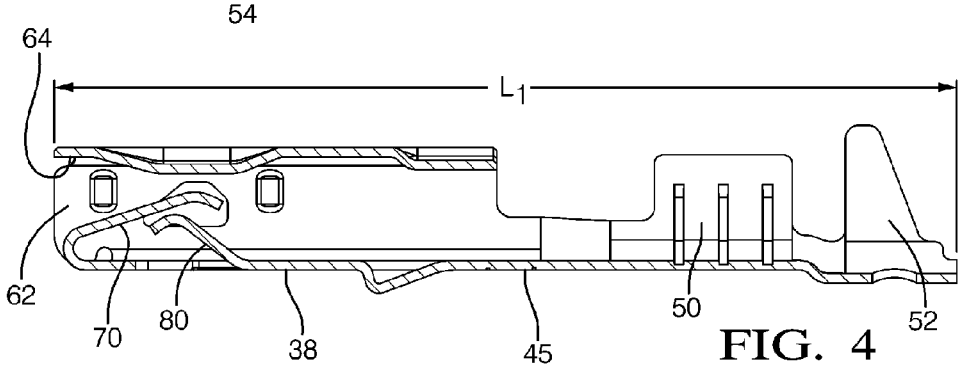
FIG. 4 shows a side cross section view of the box receptacle terminal of FIG. 3.

Referring to FIGS. 2-4, box terminal 10 is disposed along a longitudinal axis A and has a receptacle contact section, or forward box portion 42. Forward box portion 42 has a rectangular shape, or box configuration. Box terminal 10 may be manufactured in a stamped configuration (not shown) being attached to a carrier strip (not shown). Box terminal 10 is removed from the carrier strip in any conventional fashion, such as being cut away from the carrier strip, before terminal 10 is formed as part of connection system 12.

Receptacle base 38 is disposed along an axial length $L_1$ of box terminal 10. Base 38 includes a lower surface 45 that is adjacent the channel in cavity position 18 that receives cavity index 36. Forward box portion 42 and rear portion 48 are each adjoined to base 38. Rear portion 48 includes a first winged portion 50 spaced apart from a second wing portion 52. Winged portions 50, 52 are crimped on to a wire conductor 29 in communication with winged portions 50, 52 using any conventional apparatus or method, such as with an applicator press. First winged portion 50 is typically crimped to a core, or lead of wire conductor 29 and second winged portion 52 is typically crimped to an insulative outer covering of wire conductor 29 adjacent the lead of wire conductor 29. Forward box portion 42 includes spaced apart, lateral side walls 54, 56 extending generally perpendicular from receptacle base 38. Sidewall 54 has an additional sidewall 57 overlying sidewall 54 when box terminal 10 is constructed. Sidewalls 54, 56, 57 are joined together by at least one upper, or top wall 58, 60 in the formation of box terminal 10. One top wall 58 is folded over the other top wall 60 during manufacture of box terminal 10. Tab portions 59, 61 of sidewalls 54, 57 fold into an indentation in top walls 58, 60 formed by construction of a protuberance 65 in terminal 10. Protuberance 65 is opposite receptacle base 38, and inwardly faces an interior cavity 64 of box terminal 10. Additional tabs 94, 96 in a rearward portion of forward box portion 42 fold over first and second top wall 58, 60. Box terminal 10 includes an opening 62 in forward box portion 42 through which male blade terminal 24 is inserted. The area bounded by receptacle base 38, sidewalls 54, 56 and at least one top wall 58, 60 forms cavity 64 of box terminal 10. An exterior surface 66 of forward box portion 42 of terminal 10 is positioned adjacent to the walls bounding cavity position 18 of connector 14 when box terminal 10 is inserted into position 18 of connector 14. A doubled walled forward receptacle box portion provides additional strength to ensure the box portion does not come apart with repeated use so as to enhance the service life longevity of the box receptacle terminal. Alternately, any wall of the box receptacle terminal may be double-walled and may utilize one or more tabs. Still yet alternately, a single walled box receptacle terminal may be constructed using single tabs.

An overstress tab 41 is attached to a primary spring contact beam 70. Primary beam 70 may also be defined as a primary compliant beam, a resilient primary cantilever spring contact beam, or a primary cantilever spring member. Primary beam 70 communicates with overstress windows 43 defined in sidewalls 56, 54, 57 to prevent flexure overstress to primary beam 70 and a secondary beam 80. Secondary beam 80 flexes, or is overstressed only as far as allowed by primary beam 70, as primary beam 70 deflects to engage secondary beam 80. When the deflection of primary beam 70 is stopped by overstress tab 41 making contact with a bottom edge of overstress windows 43, deflection of secondary beam 80 also stops. Overstess tab 41 configured on primary beam 70 as shown in FIG. 3 is well known in the art.

Figure 5:
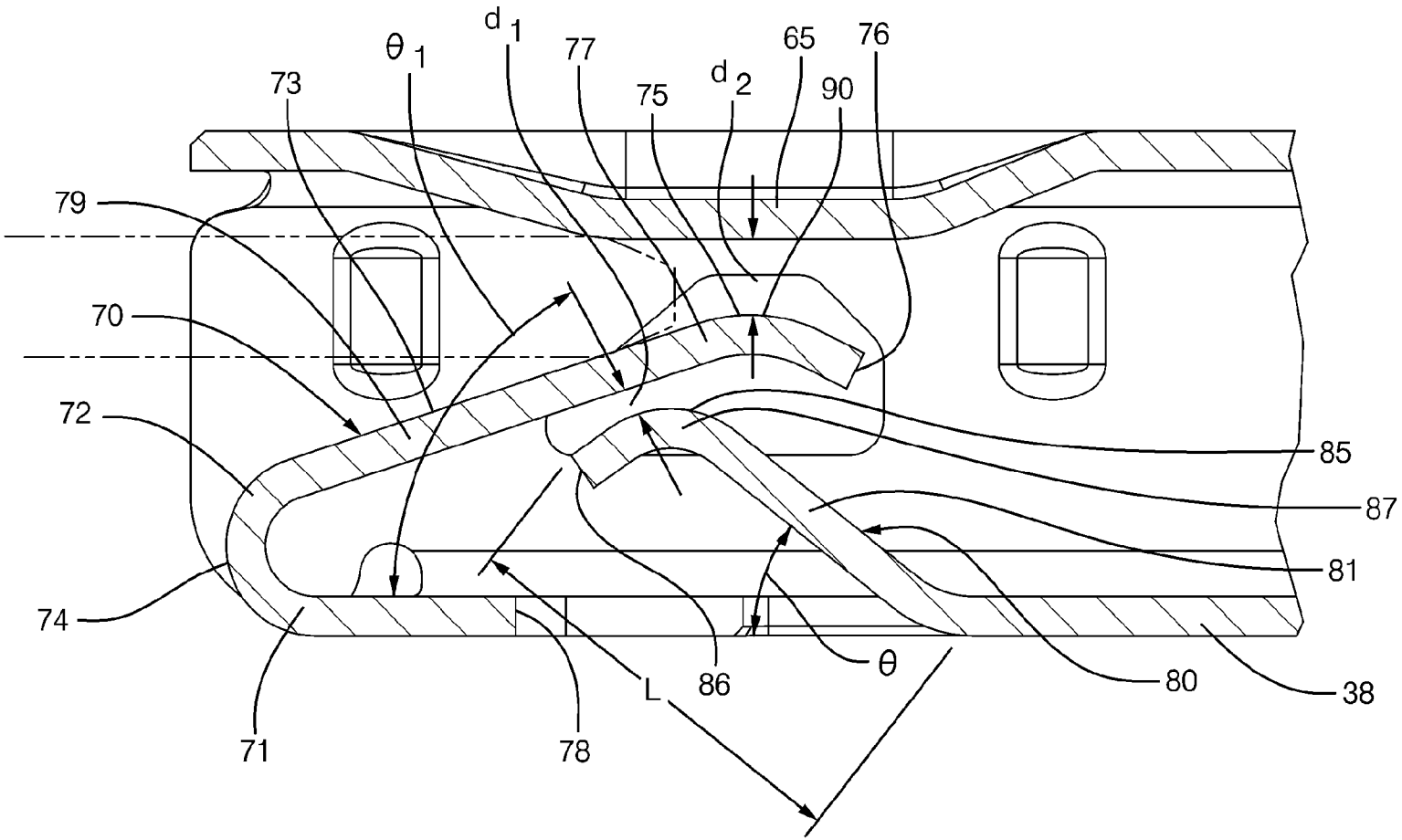
FIG. 5 shows a magnified view of the box receptacle terminal of FIG. 4, showing the primary and the secondary contact beam details thereof.

Primary and secondary beam 70, 80 form an arrangement in cavity 64 that works in combination to electrically and mechanically secure male terminal 24 to box terminal 10. Beams 70, 80 are spaced apart in cavity 64 when in the neutral position, as best illustrated in FIG. 5. A plane defined through axis A contains protuberance 65 and beams 70, 80. Referring to FIG. 6A, male terminal 24 is inserted in an axial, mating direction 95 into forward box portion 42. When male terminal 24 is inserted into cavity 64, a normal contact force is applied in a direction 97 so primary beam 70 deflects to make contact with secondary beam 80, which, in turn, also deflects in combination with primary beam 70. With continued insertion of male terminal 24 against primary beam 70, male terminal 24 makes contact with a zenith 90 of primary beam 70 for the remainder of the insertion of male terminal 24 received into box terminal 10. The combination of the mating forces countering the normal contact force from the insertion of male terminal 24 provided by the deflection of primary and secondary beam 70, 80 against male terminal 24 in box terminal 10 is suitable to establish a reliable electrical and mechanical connection of male terminal 24 to box terminal 10. Referring to the graph in FIG. 10, preferably, the reliable electrical and mechanical connection is generated so that a difference 131 between a peak engage force 128 and a sliding engage force 132 of male terminal 24 received into cavity 64 against primary beam 70 is at minimum.

Referring to FIG. 5, primary beam 70 includes a first beam portion 71, a reversely bent portion 72 that is a forward portion 73 of primary beam 70 in cavity 64, a leading edge 74, and a free end 75 that includes a distal end 76, and a receptacle base end 78 that joins primary beam 70 with receptacle base 38. Primary beam 70 joins, or transitions from base 38 so that primary beam 70 extends forward towards opening 62 of box terminal 10. Non-free end portion, or straight portion 79 and free end 75 combine to form a forward portion 73 that extends backward, or is bent backward into cavity 64 away from opening 62. Forward portion 73 has an upper surface that faces towards top walls 60, 58 and a lower surface opposite the upper surface that angularly faces towards secondary beam 80 and base 38. Free end 75 forms an arcuate end 77 that is adjacent distal end 76 of forward portion 73. Arcuate end 77 opposes protuberance 65 and is spaced apart from protuberance 65 a distance less that a thickness of male terminal 24 inserted into terminal 10 when box terminal 10 is in the neutral position. First beam portion 71 extends from base end 78 being substantially in the same plane as receptacle base 38 when primary beam 70 is in its neutral configuration. A neutral configuration for box terminal 10 is where box terminal 10 has been constructed and has not yet received male terminal 24, as illustrated in FIGS. 2-5. First beam portion 71 of primary beam 70 transitions and extends in to a reversely bent portion 72 at leading edge 74 which extends away from opening 62 into cavity 64. Receptacle base end 78 of primary beam 70 communicates with receptacle base 38 of box terminal 10. Arcuate end 77 is formed so that its concave surface faces receptacle base 38 and its convex surface faces protuberance 65. Zenith 90 of primary beam 70 in cavity 64 is disposed on the convex surface of arcuate end 77. Zenith 90 on arcuate end 77 is the highest point of primary beam 70 in cavity 64 that is disposed closest to protuberance 65. Arcuate end 77 has a first radius of curvature. Zenith 90 provides a minimum area for mating male terminal 24 to engage the convex portion of arcuate end 77, yet allow effective sliding of male terminal 24 into and out of cavity 64. When male terminal 24 is removed from cavity 64, the convex portion of arcuate end 77 may assist to prevent undesired buckling of box terminal 10 in contrast to a free end of a primary beam being constructed having a flat surface. A buckled box terminal 10 may be a damaged box terminal that requires servicing which increases service costs. Zenith 90 is spaced from protuberance 65 by distance $d_2$ that is less than a thickness of male terminal 24 when terminal 10 is in the neutral position. Gap $d_2$ is generally perpendicular to axis A when box terminal 10 is in the neutral position. Male terminal 24 is inserted into opening 62 and into gap $d_2$, and with greater applied insertion force against male terminal 24, subsequently inserted past zenith 90 further into forward box portion 42. A stop in the rearward section of forward box portion 42 would prevent further insertion of male terminal 24 into forward box portion 42. A normal contact force is applied at zenith 90 in a direction 97 generally perpendicular to mating axis A on arcuate end 77 resulting from insertion of male terminal 24 into cavity 64 where male terminal 24 engages primary beam 70. The normal contact force is generally applied at zenith 90 about perpendicular to axis A in a direction defined by gap $d_2$. The normal contact force applied on primary beam 70 at zenith 90 from inserted male terminal 24 is further illustrated in the graph in FIG. 9.

Secondary beam 80 is formed from base 38 and extends into cavity 64 towards opening 62 at an angle Θ with respect to receptacle base 38. Secondary beam 80 is also defined as a secondary compliant beam, a resilient secondary cantilever spring contact beam, or a secondary cantilever spring member. The non-free end portion, or majority portion 81 of secondary beam 80 extends from receptacle base 38 into cavity 64 having a direction of elevation that traverses straight portion 79 of primary beam 70. Angle Θ is maintained along a non-free end portion, or majority portion 81 of a length $L_2$ of secondary beam 80. Angle Θ is an acute angle. Preferably, angle Θ has a range of 25 to 70 degrees in relation to receptacle base 38. More preferably, angle Θ is in a range of 30-60 degrees. Even more preferably, angle Θ is about 35-50 degrees. Angle Θ is selected to ensure difference 131 of peak engage force 128 and sliding engage force 132 of male terminal 24 is received into box receptacle terminal 10 is at a minimum. The primary and secondary beam 70, 80 are inwardly tapered with increased insertion of male terminal 29 to facilitate tooling in construction of terminal 10.

Secondary beam 80 further includes a free end 85 having a distal end 86 where free end 85 is an arcuate end 87. Arcuate end 87 is disposed beneath the lower surface of primary beam 70 in an overlapping, spaced relationship thereto remote from arcuate end 77 of primary beam 70. Arcuate end 87 has a second radius of curvature. A radius of primary beam 70 has a greater value than a radius of secondary beam 80. A convex portion of arcuate end 87 faces straight portion 79 of primary beam 70 so that the convex portion provides a minimum contact area to straight portion 79 when straight portion 79 makes contact with the convex portion of arcuate end 87. The convex portion of arcuate end 87 also allows arcuate end 87 to easily sliding engage against straight portion 79 towards opening 62 when primary beam 70 engagingly contacts secondary beam 80. Arcuate ends 77, 87 have an offsetting, spaced relationship generally perpendicular to axis A. Arcuate end 87 of secondary beam 80 is disposed closer to opening 62 of box terminal 10 than arcuate end 77 of primary beam 70. Opening 62 receives male terminal 24 so that male terminal 24 contacts arcuate end 77 of primary beam 70 such that the lower surface of straight portion 79 of primary beam 70 deflects along the gap deflection direction of a space, or gap $d_1$ to contact arcuate end 87 of secondary beam 80 so that arcuate end 87 slidingly engages along the lower surface of straight portion 79 of primary beam 70 towards opening 62.

More particularly, arcuate end 87 of secondary beam 80 is disposed beneath straight portion 79 of primary beam 70 in an overlapping, spaced relationship thereto and remote from arcuate end 77 of primary beam 70. Arcuate end 87 is spaced apart from straight portion 79 by gap $d_1$. More specifically, gap $d_1$ is disposed at a location between beams 70, 80 between a point of contact disposed along an exterior surface of forward portion 73 that faces base 38 and a contact point disposed on a convex exterior surface of arcuate portion 87 where primary beam 70 engages secondary beam 80 when mating male terminal 24 is inserted into opening 62 of box terminal 10. Gap $d_1$ collapses, or closes with the deflection of primary beam 70 in a gap deflection direction along gap $d_1$ that is nonorthoginal to axis A. The gap deflection direction of gap $d_1$ has an angle of rotation $\Theta_1$ in relation to receptacle base 38 and axis A. The angle of rotation $\Theta_1$ of the gap deflection direction of gap $d_1$ is an acute angle in relation to axis A. A distance of gap $d_1$ and angle of rotation $\Theta_1$ have values that are selected so difference 131 of peak engage force 128 and sliding engage force 132 of male terminal 24 is received into box receptacle terminal 10 is at a minimum and the permanent set 114 of the primary beam 70 and the secondary set (not shown) of the secondary beam 80 are about the same. Typically, a gap between dual contact beams provides decreased terminal insertion of a male terminal. If this typical gap did not exist and the contact beams engage with the insertion of the male terminal, an increased insertion force would be required to insert the male terminal into the forward box portion because both beams would need to deflect at the same time. Having gap $d_1$, the overall insertion force of male terminal 24 may be reduced since the deflection of each beam 70, 80, respectively, occurs at a different insertion depth of male terminal 24 along length $L_1$ of box terminal 10. While the insertion force of male terminal 24 may be reduced with gap $d_1$ disposed intermediate primary and secondary beam 70, 80, the normal contact force applied to primary beam 70 by inserted male terminal 24 may be maximized. Location of gap $d_1$ provides the advantages of the typical gap discussed above and also provides the added benefit of an increased normal contact force applied to male terminal 24 by primary and the secondary beam 70, 80 due to the shape and the geometry of beams 70, 80 as discussed herein. Primary and secondary beam apply this normal contact force against male terminal 24 in a direction opposite direction 97 when male terminal is received into box terminal 10, as best illustrated in FIG. 8.

Figure 7A:
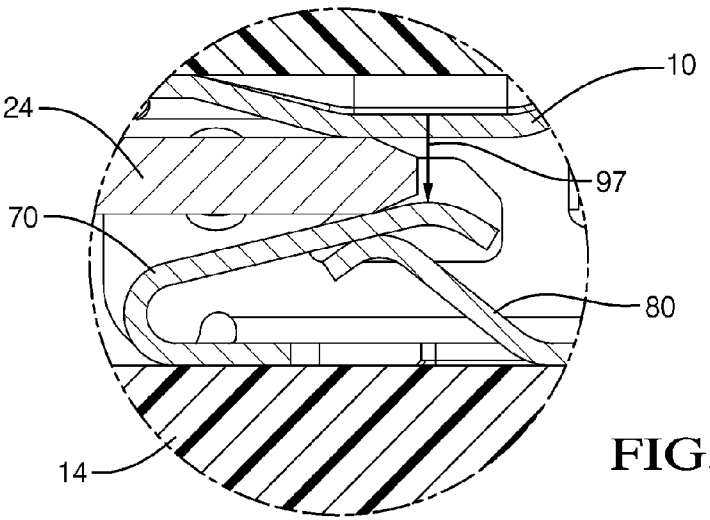
FIG. 7A shows a magnified view of the box receptacle terminal of FIG. 7, showing the primary and the secondary beam details thereof.
Figure 8:
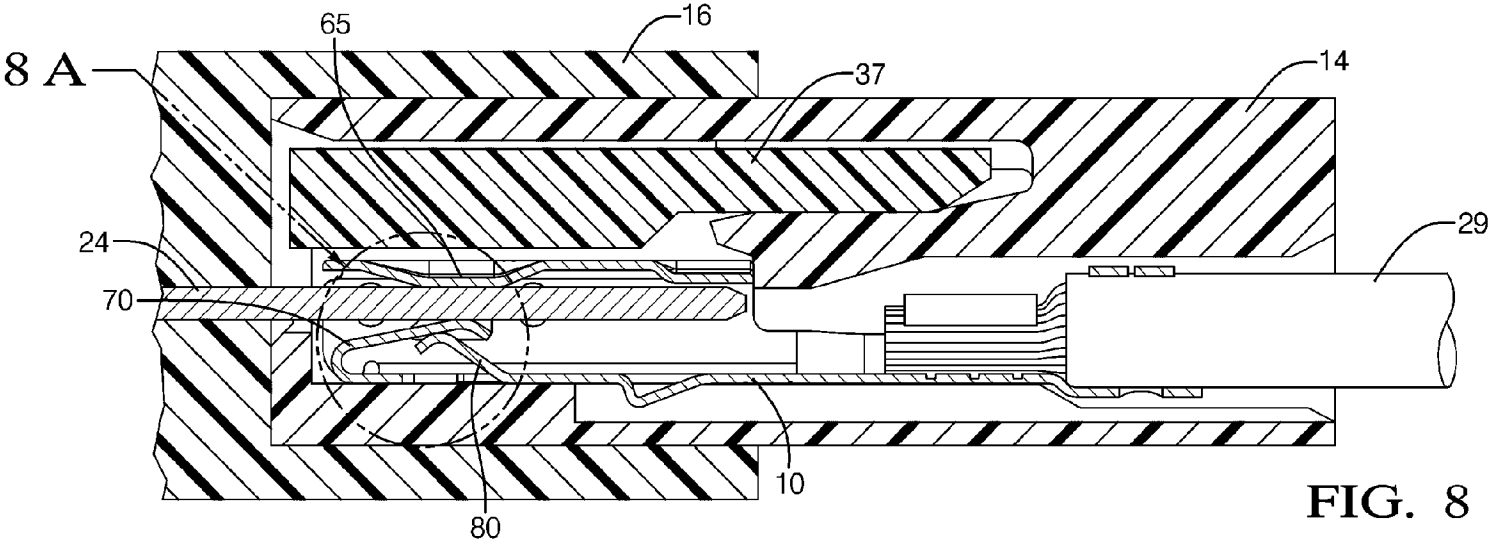
FIG. 8 shows a cross section of the box receptacle terminal of FIG. 7 with the mating male terminal fully inserted in the cavity of the box receptacle terminal.
Figure 8A:
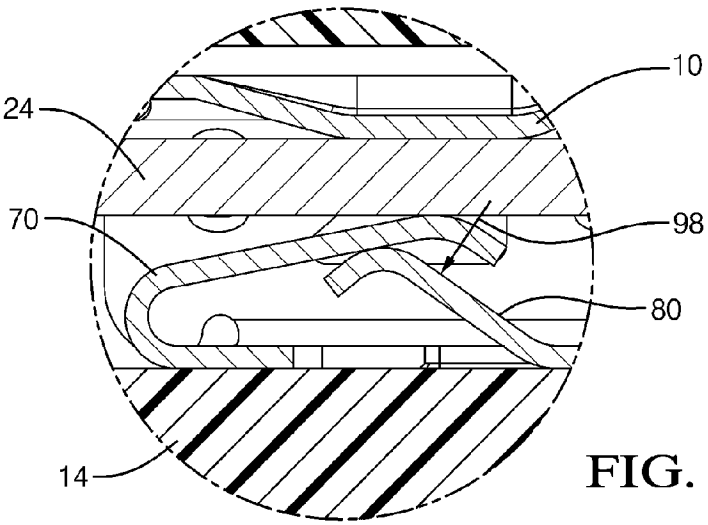
FIG. 8A shows a magnified view of the box receptacle terminal of FIG. 8, showing the primary and the secondary beam details thereof.

Offsetting arcuate ends 77, 87 in combination with the geometry and the structure of primary and secondary beam 70, 80 ensure arcuate ends 77, 87, respectively, do not engage when male terminal 24 is inserted into cavity 64 of box terminal 10 through opening 62 until male terminal 24 is fully inserted in cavity 64, as best illustrated in FIG. 8. This occurs as arcuate end 87 is engaged by straight portion 79 as shown in FIG. 7A at a point of engagement and this point of engagement on arcuate end 87 slidingly moves in a forward direction 98 along straight portion 79 of primary beam 70 towards opening 62 with continued insertion of mating terminal 24 and deflection of secondary beam 80. Referring to FIG. 8A, the point of engagement of straight portion 79 against arcuate end 87 in FIG. 8A is forward of the point of engagement of straight portion 79 against arcuate end 87 as shown in FIG. 7A when arcuate end 87 is initially engaged by straight portion 79.

Figure 9:
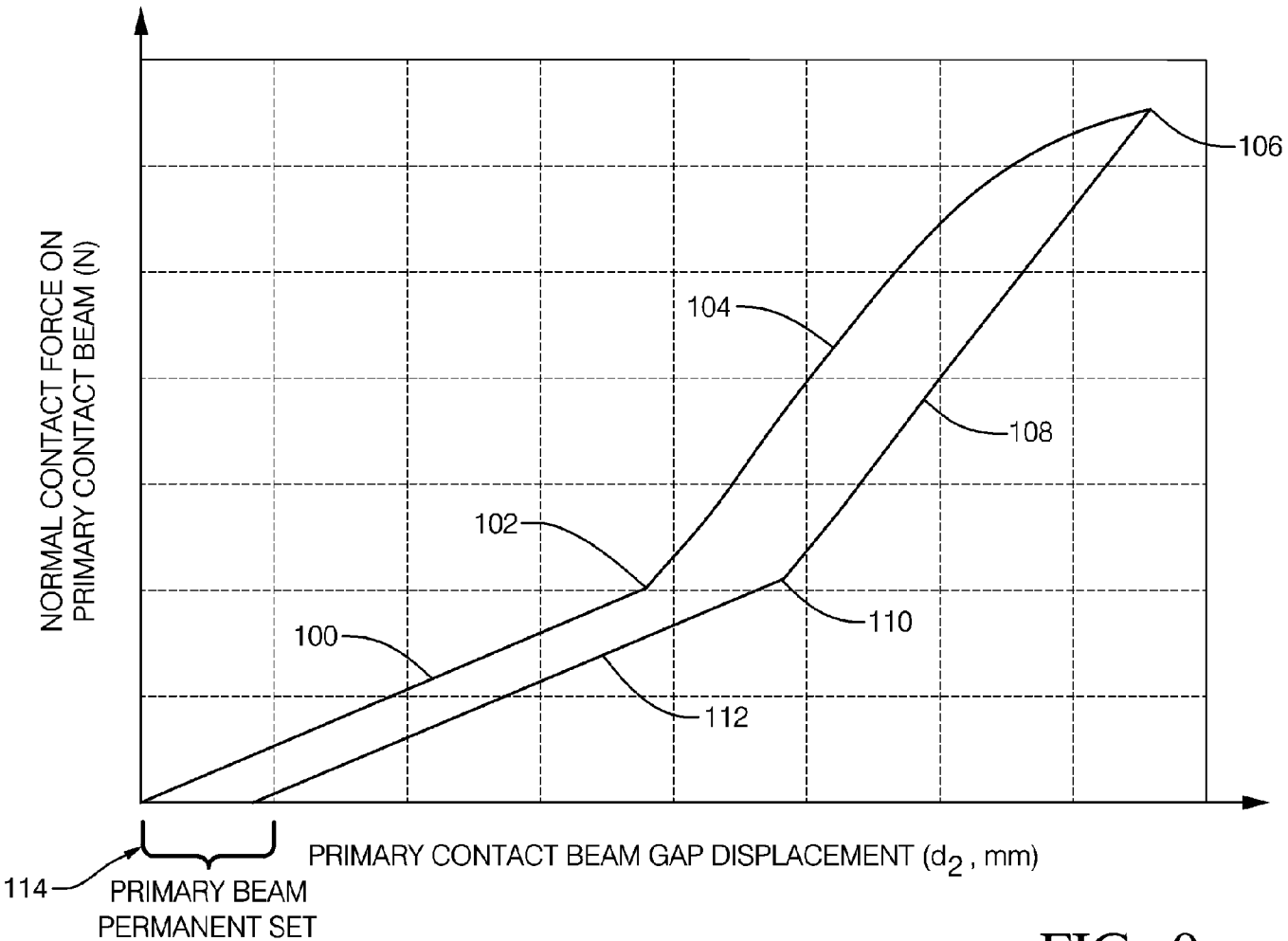
FIG. 9 shows a graph of the overall normal contact force applied on the primary contact beam verses the primary beam gap displacement disposed between a top wall of the box receptacle terminal and the primary contact beam of the box receptacle terminal of FIG. 5.
Figure 10:
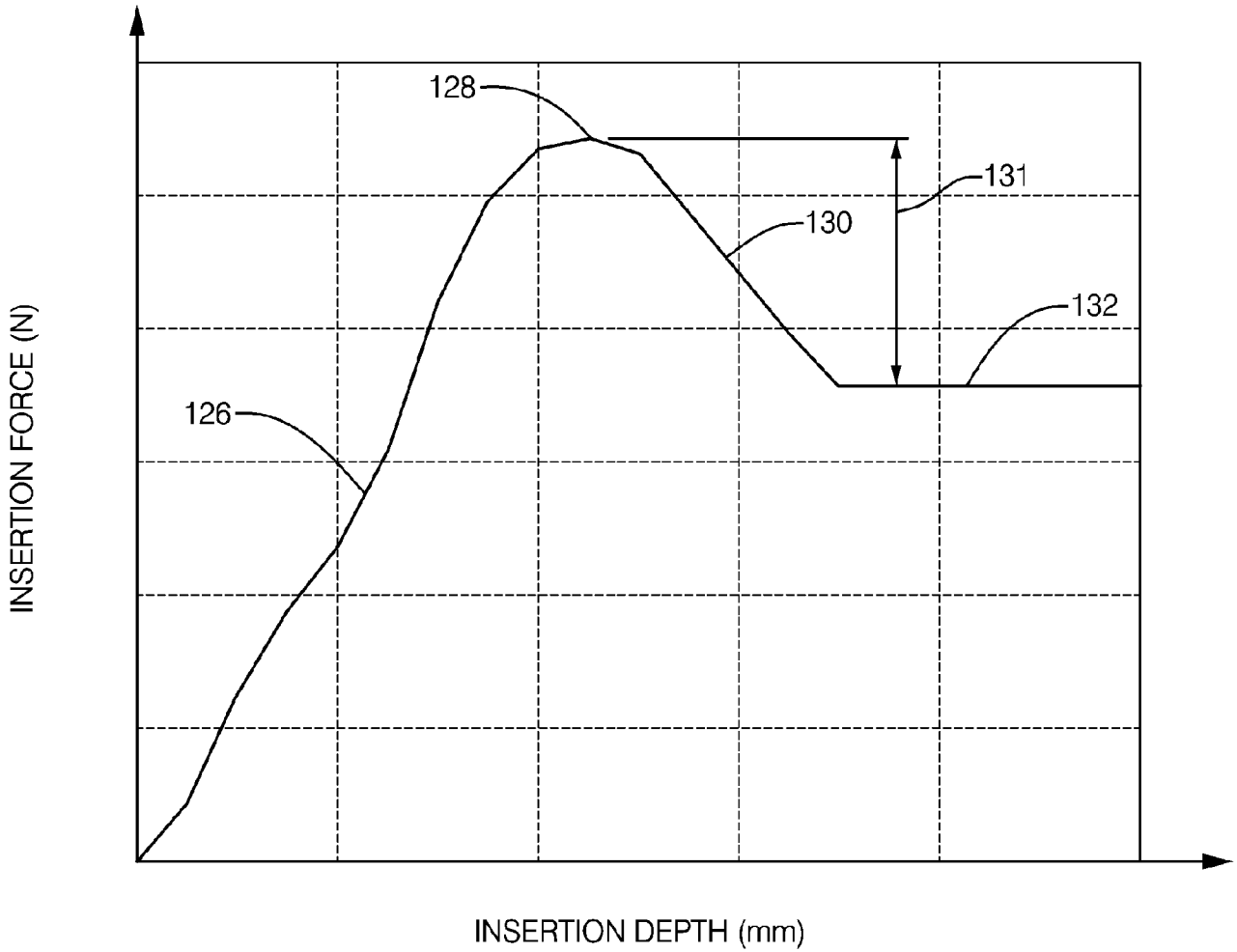
FIG. 10 shows a graph of the insertion force of the mating terminal versus the insertion depth of the mating terminal in to the cavity along a length of the box receptacle terminal of FIG. 5.

FIGS. 9-10 illustrate graphs of various forces during the insertion of male terminal 24 in box terminal 10. FIG. 9 illustrates the overall normal contact force on primary beam 70 measured in Newton (N) versus the primary contact beam gap displacement ($d_2$, in millimeters) when male terminal 24 is inserted and received in box terminal 10, and is shown by reference numerals 100, 102, 104, and 106. Reference numeral 102 is where non-free portion 79 of primary beam 70 engages free end 87 of secondary beam 80. Reference numeral 106 is the normal contact force of the primary and secondary beam 70, 80 after male terminal 24 is fully mated in box forward portion 42, as shown in FIG. 8. Reference numerals 108, 110, 112 are the normal contact force when the male terminal is being removed from box forward portion 42, and reference numeral 108 is where straight portion 79 of primary beam 70 disengages from arcuate end 87 of secondary beam 80. FIG. 10 illustrates the insertion force (N) of male terminal 24 into box terminal 10 versus the insertion depth in millimeters of male terminal 24 into box terminal 10 along length $L_1$. Primary beam 70 has a primary beam permanent set 114 and secondary beam 80 has a secondary beam permanent set which is a similar feature for secondary beam 80 as the primary set is for primary beam 70, and preferably, primary beam set 114 and the secondary beam set are about the same with respect to defining the distance of gap $d_1$.

The distance of gap $d_1$ is preferably selected so difference 131 of peak engage force 128 and sliding engage force 132 of male terminal 24 received into box receptacle terminal 10 is at a minimum. When the primary and secondary beam permanent sets are about the same for beams 70, 80, this ensures that each beam 70, 80 will share the load to provide a balanced mating force to counter the insertion force from male terminal 24 into cavity 64. Distance $d_2$ is selectively chosen to maximize a normal contact force while minimizing the peak engage force of the inserted male terminal 24 in box terminal 10. Further, distance $d_2$ is sized, when terminal 10 is in the neutral position to be greater than zero at all manufacturing tolerances extremes in construction of terminal 10 in order to minimize the peak engage force 128 applied by the male mating terminal 24. When the primary and the secondary beam permanent sets are not about the same, one of the two beams may share more of the insertion load burden of the male terminal. The overloaded beam is not optimized to share the insertion load in relation to the underloaded beam, this configuration may not allow the additional material savings to construct the terminal to be realized. Thus, the sets of the beams may be sufficiently adjusted to allow for a similar beam set to allow a maximum material savings in construction of the terminal. Distance $d_1$ is selectively chosen to be greater than zero so as to minimize the peak engage force applied by inserted male terminal 24.

Referring to FIG. 2, when connector 16 is not mated with connector 14, male terminal 24 is not received in cavity 64 of box terminal 10. When mating terminal 10 is not received in cavity 64, a normal contact force is not applied in a direction 97 against primary beam 70 so that primary beam 70 does not deflect and does not engage secondary beam 80. And as the secondary beam 80 is not engaged by primary beam 70, secondary beam also does not deflect in a direction 98. Primary beam 70 remains spaced apart from secondary beam 80 in a neutral configuration of box terminal 10, as best illustrated in FIGS. 2 and 5.

Figure 6:
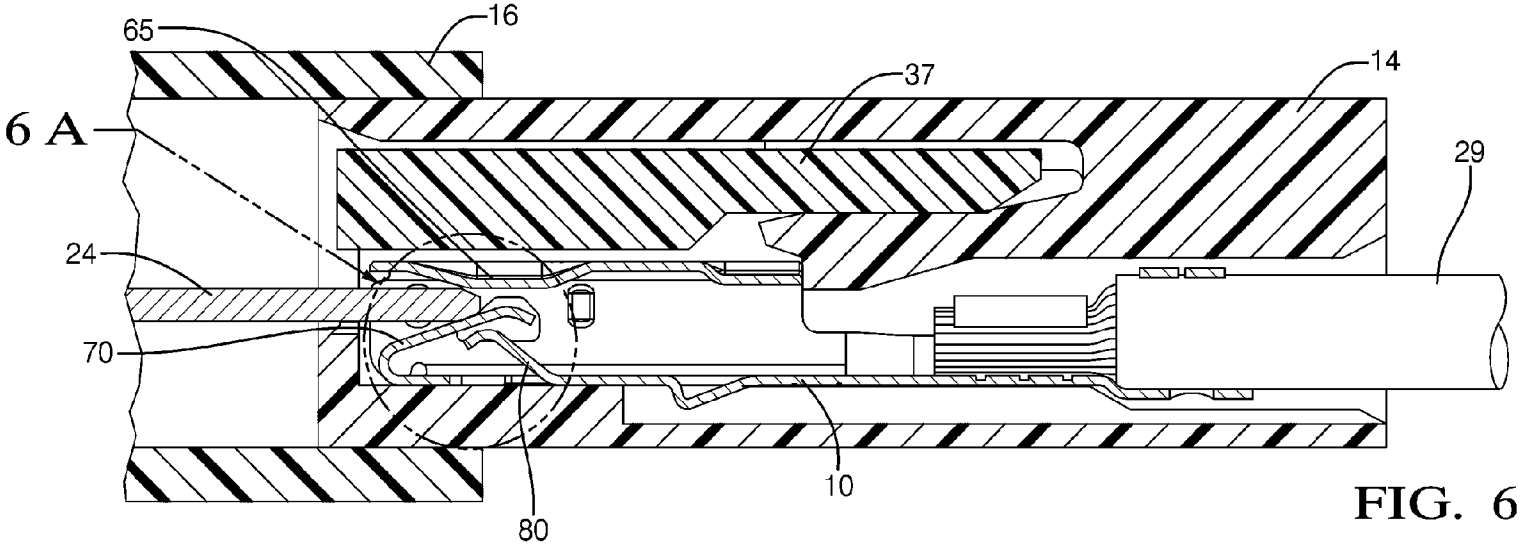
FIG. 6 shows a cross section of the box receptacle terminal of FIG. 2 with a mating male terminal entering an opening of a cavity of the box receptacle terminal.
Figure 6A:
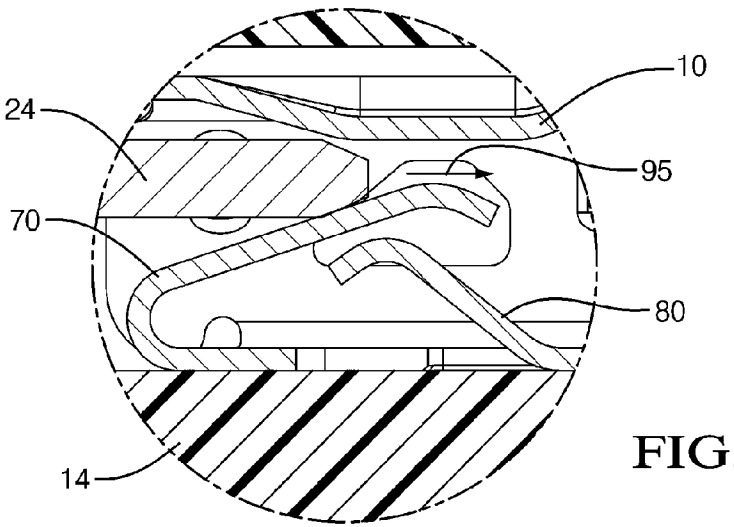
FIG. 6A shows a magnified view of the box receptacle terminal of FIG. 6, showing the primary and the secondary beam details thereof.
Figure 7:
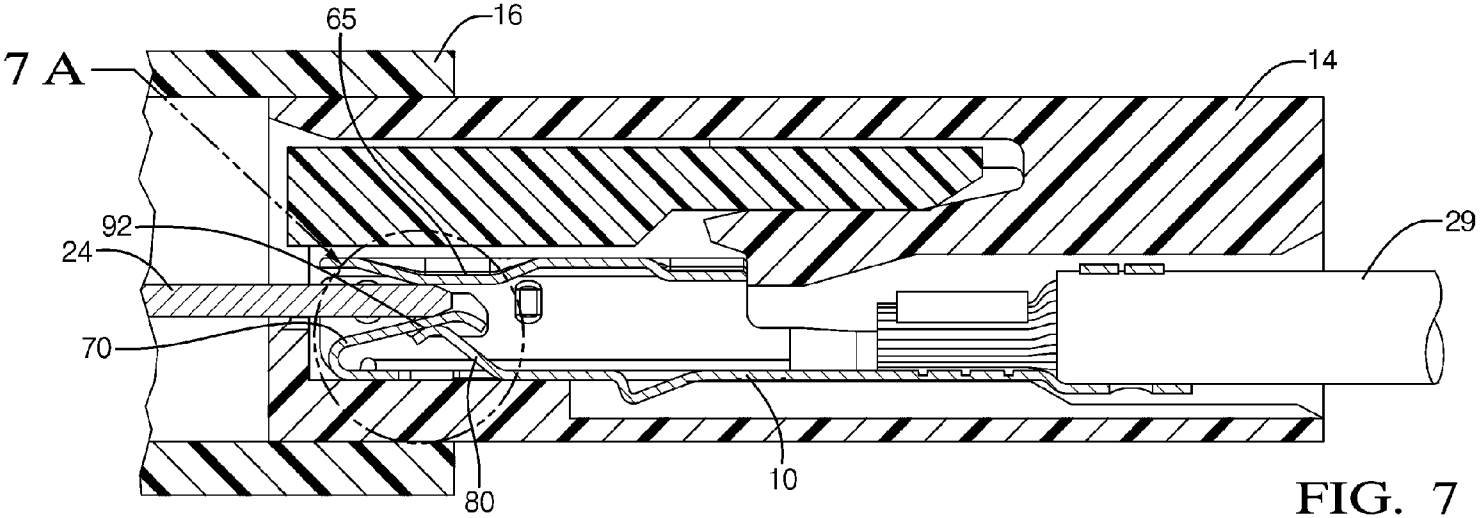
FIG. 7 shows a cross section of the box receptacle contact of FIG. 6 with the mating male terminal engaging the primary contact beam of the box receptacle terminal.

Referring to FIGS. 6-10, when connector 16 is mated to connector 14, male terminal 24 is received in opening 62 of box terminal 10. FIGS. 6-8 illustrate the progressive insertion of male terminal 24 into box terminal 10 and the subsequent deflection of primary beam 70 to engage secondary beam 80 which then deflects to supply a combined mating force against inserted male 24 at zenith 90 as best shown in FIGS. 8 and 8A. Graphs 9-10 graphically depict the forces associated with the on-going insertion of male terminal 24 into forward box portion 42 of box terminal 10.

When male terminal 24 is received into opening 62 of box terminal 10, male terminal 24 makes contact with forward beam portion 71. Referring to FIG. 9, this insertion action is shown by reference numeral 100, and is shown in FIG. 6A. Forward beam portion 71 guides male terminal 24 rearward of forward box portion 42 until male terminal 24 also makes contact with protuberance 65 at gap $d_2$. As the axial insertion force increases to mating contact 24, male terminal 24 deflects primary beam 70 in a gap deflection direction that closes gap $d_1$ in an angularly direction towards receptacle base 38. When gap $d_1$ is completely collapsed, or closed, the lower surface of straight portion 79 of forward portion 73 of primary beam 70 contacts arcuate end 87 of secondary beam 80, as shown at reference numeral 102 in FIG. 9, and as best shown in FIG. 7A. A point of contact is at zenith 90 where straight portion 79 of primary beam 70 contacts arcuate end 87 of secondary beam. Another point of contact along length $L_1$ of box terminal 10 is defined where non-free end portion 79 of primary beam 70 contacts arcuate end 87 of secondary beam 80. This point of contact along length $L_1$ of box terminal 10 is closer, or more forward towards opening 62 of box terminal 10 than the point of contact at zenith 90, as shown in FIGS. 8 and 8A. As secondary beam 80 deflects towards receptacle base 38, secondary beam 80 provides further resistance so that a cantilever force is generated with the primary and secondary beam that combine to apply this overall cantilever force against mating terminal 24 to maintain robust electrical contact between the terminals 10, 24. Maximum displacement of secondary beam 80 also occurs when displacement of primary beam 70 is at a maximum. The maximum displacement of the beams is in relation to the constant cross section geometry of the inserted male terminal 24. The maximum deflection of the primary and secondary beam with insertion of male terminal 24 into terminal 10 is shown at reference numeral 106 in FIG. 9, and as shown in FIG. 8A.

Turning our attention now to the insertion force for male terminal 24 into cavity 64 of box terminal 10, as shown in FIG. 10, the insertion force increases when male terminal is disposed at gap $d_2$ as shown by reference numeral 126 until peak engage force 128 is reached. If male terminal 24 strikes and engages primary beam 70, or primary beam 70 in combination with top wall 60 before reaching zenith 90, forward portion 73 of primary beam 70 and top wall 60 funnel, or guide male terminal 24 towards zenith 90 with marginal deflection of primary beam 70. The peak engage force is that force needed to overcome the male terminal geometry at a distal end of male terminal 24 when inserted at gap $d_2$. Once the geometry at the distal end of male terminal 24 is overcome in at gap $d_2$, the constant geometry of male terminal 24 slidingly engages along zenith 90, as shown in FIGS. 8 and 8A. Zenith 90 is defined as a point of contact along length $L_1$ of box terminal 10 for male terminal 24. The insertion force decreases as shown by reference numeral 130 until a constant sliding engage force is present as represented by reference numeral 132. The constant sliding engage force 132 is present when the constant cross section of male terminal 24 is sliding across zenith 90 after initial insertion of male terminal 24 past primary beam 70. The distance of gap $d_1$ is selected so as to ensure that difference 131 between peak engage force 128 and sliding engage force 132 is at a minimum. Preferably, it is desired to have a maximum normal contact force supplied by male terminal 24 and a difference 131 being a minimum. With the beam geometry of beams 70, 80, the normal contact force may be greater than with a single beam while also minimizing the permanent set of beams 70, 80. Should primary beam 70 continue to deflect past maximum position 106, overstress tab 41 will prevent further deflection to stop primary beam 70 at a position defined by overstress window 43 to prevent permanent overstress to primary and secondary beams 70, 80. This may occur if a foreign object is inserted through opening 62 of box terminal 10.

The combination of mating forces applied by beams 70, 80 to resist the insertion force of male terminal 24 results in a robust electrical and mechanical connection between box terminal 10 and mating terminal 24. Because beams 70, 80 combine to sustain a substantial portion of the normal contact force applied by the inserted male terminal 24 so that difference 131 between peak engage force 128 and sliding engage force 132 of male terminal 24 inserted into box terminal 10, the thickness of walls 54, 56, 57, 58, 60 and tabs 59, 61, 94, and 96 of box terminal 10 may be decreased.

The arrangement of the beams 70, 80 in relation to each other in cavity 64 allows for the beam structures to be moved further forward towards opening 62 of box receptacle portion 42 than other proposed terminals that have a pair of beams. First, this may allow a shorter forward portion 73 of primary beam 70 to extend into cavity 64 of box terminal 10. A shorter forward portion 73 translates in less material required to construct box terminal 10 at a decreased cost. Second, this may allow a male terminal having a shorter length to be used to achieve the electrical connection with primary beam 70. A shorter male terminal uses less material in construction of the male terminal that decreases manufacturing costs of the male terminal. Box terminal 10 having forward box portion 42 being a decreased length requires less material to construct box terminal 10. Third, as primary beam 70 deflects and engages secondary beam 80 for a combined deflection to absorb the normal contact force from insertion of male terminal 29, the walls of terminal 10 may also be constructed having a decreased thickness as they no longer need to be as robust to absorb the normal contact force applied by the inserted male terminal. Decreased thickness of walls 54, 56, 57, 58, 60 result in decreased mass of box terminal 10. Fourth, secondary beam 80 extends into cavity 64 closer to opening 62 more than other proposed terminals that have a pair of beams. Thus, secondary beam 80 is substantially disposed beneath primary beam 70 when box terminal 10 is in the neutral position, as best illustrated in FIG. 5. This feature may allow the remaining rearward section of box contact portion 42 to be available to employ other possible terminal features, such as index ribs, for example. Secondary beam 80 also has a steeper angle of rotation than other proposed terminals having a pair of beams that have smaller angles of rotation. The angle of rotation of secondary beam 80 being maintained at least along majority portion 81 into cavity 64 allows secondary beam 80 to have increased stiffness that may result in secondary beam 80 applying a stronger mating force against male terminal 24 when male 24 is received by box terminal 10. Thus, a shorter primary beam, decreased male terminal blade, a shorter length of the forward box portion, decreased wall thickness of the box terminal, and a steeper angle of rotation of the secondary beam may combine to result in a box terminal constructed with less material having decreased mass at a reduced cost while providing an increased mating force against a male terminal received into the box terminal. For example, one known box terminal having a single primary beam may have an undesired 10-20% greater mass than box terminal 10 when used with an associated mating terminal.

Male terminal 24 is removed from cavity 64 through opening 62 when connectors 14, 16 are unconnected (not shown). For example, this may occur if the electrical signals supplied by the connectors are to an electronic device in the vehicle that needs servicing. Before servicing the electronic device, connectors 14, 16 are disconnected from each other, and hence, male terminal 24 is similarly disconnected from box terminal 10. Male terminal 24 slides axially away from primary beam 70 and cavity 64 for removal from box terminal 10. This action is shown by reference numerals 108, 110, and 112 in FIG. 9. Primary beam 70 disengages from secondary beam 80 at reference numeral 110. Contact beams 70, 80 each readjust to an orientation in box terminal 10 according to their respective primary set 114 and secondary set.

Alternately, these box terminals may be used in any connection system used in the motorized transportation industry. Still yet alternately, these box terminals and corresponding mating terminals, and connection systems employing these types of terminals may be used anywhere a reliable connection system is needed.

Thus, a robust and reliable box receptacle terminal is provided where the primary and secondary beams combine to sustain the normal contact force of the inserted male terminal. The arrangement of the primary and the secondary beam is such that the box receptacle terminal may be constructed using less material than at least a known box receptacle terminal having only a primary beam. The primary beam deflects in a gap deflection direction to close a gap $d_1$ between the primary and secondary beam and engage the secondary beam along a straight portion of the primary beam. This is facilitated by a free end of the secondary beam being disposed beneath the lower surface of the primary beam remote from the free end of the primary beam when the box terminal is in the neutral position. The secondary beam extends from the receptacle base forward to the opening of the box terminal allowing a rearward section of the box contact portion to be utilized for other features of the terminal. The majority portion of the secondary beam has a steeper angle of rotation relative to the receptacle base, preferably being in a range of 25-70 degrees. This steeper angle of rotation may assist to produce an increased mating force supplied by a combination of the primary and the secondary beam against a mating terminal received into the box receptacle terminal. The gap deflection direction of gap $d_1$ has an angle of rotation that is an acute angle in relation to the receptacle base. The distance of gap $d_1$ is chosen to ensure that a difference between a peak engage force and a sliding engage force of the inserted male terminal is at a minimum. This is important to ensure that the primary and secondary beam absorb a substantial amount of the normal contact force applied from the inserted male terminal in gap $d_2$. Because the primary and the secondary beams combine to sustain the normal contact force of the inserted male terminal in the cavity, the walls of the box terminal may be formed having a decreased thickness as the walls do not need to sustain a major portion of the insertion force of the male terminal. The structure of the primary and secondary beam each include arcuate ends where the arcuate end of the secondary beam is closer to an opening of the box receptacle terminal than the arcuate end of the primary beam that receives the mating terminal. This feature, along with the arcuate end of the secondary beam slidingly engaging against the straight portion of the primary beam assists to ensure that the arcuate ends of the beams, respectively, to not engage each other when the male terminal is inserted in to the cavity of the box receptacle terminal at gap $d_2$. These box terminals may be used in single terminal connectors or in connection systems having a plurality of receptacles. The primary and the secondary permanent sets are configured to be about the same so that the primary and the secondary beam each share receiving the insertion force of the male terminal. The box receptacle terminals may be constructed in a plurality of geometries for a variety of wiring applications, such as the geometries having the male blade terminal width of approximately 1.5 and 2.8 millimeters. These terminal widths have been accepted by a number of organizations recognized in the automotive industry, such as USCAR.

While this invention has been described in terms of the preferred embodiment thereof, it is not intended to be so limited, but rather only to the extent set forth in the claims that follow.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical terminal comprising:

a receptacle contact section disposed along a length of the electrical terminal having a bottom wall and an upper wall;

a primary cantilever spring member extending outwardly from a forward portion of said receptacle contact section and extending from said bottom wall and being bent back into a cavity of the receptacle contact section, said primary member being angularly positioned and having an upper surface facing the upper wall and a lower surface opposite the upper surface, the primary member further including an arcuate end, said arcuate end having a distance from the upper wall that is less than a thickness of a matable contact member; and a secondary cantilever spring member being formed from said bottom wall extending into said cavity of said receptacle contact section and having an arcuate end, said arcuate end of the secondary member having an underlying, spaced relationship with the lower surface of the primary member, wherein the arcuate end of the primary member is disposed between intermediate the upper wall and the secondary member along a height of said cavity of the receptacle contact section and the arcuate end of the secondary section is disposed intermediate the forward portion and the arcuate end of the primary member along the length, and wherein the lower surface of the primary member remote from the arcuate end of the primary member and the arcuate end of the secondary member define a nonorthogonal gap in relation to the bottom wall, and when the matable contact member is received into the receptacle contact section, the gap closes such that the lower surface of the primary member remote from the arcuate end of the primary member engages the arcuate end of the secondary member, and wherein the gap comprises a distance that allows a difference between a peak engage force and a sliding engage force of the matable contact member when the matable contact member is received into the receptacle contact section to be a minimum.

2. The terminal according to claim 1, wherein the matable contact member engages a zenith of the arcuate end of the primary member when the matable contact member is inserted in the receptacle contact section, and the lower surface of the primary member remote from the arcuate end of the primary member engages the arcuate free end of the secondary member at another point of contact different from a zenith of the arcuate end of the secondary member disposed along the length.

3. The terminal according to claim 1, wherein a portion of the primary member deflects so that the gap closes in a gap deflection direction so that the lower surface of the primary member remote from the arcuate end of the primary member engages the arcuate end of the secondary member along the gap deflection direction when the matable contact member is received into the cavity, said gap deflection direction being an acute angle in relation to the bottom wall.

4. The terminal according to claim 1, wherein when the matable contact member is received by the receptacle contact section, a portion of the primary member that does not include the arcuate end of the primary member deflects to engage the arcuate end of the secondary member such that said arcuate ends of the primary member and the secondary member, respectively, do not engage.

5. The terminal according to claim 1, wherein a majority portion of the secondary member intermediate the arcuate end of the secondary member and the bottom wall extends from the bottom wall and has an angle of rotation, said angle of rotation being an acute angle in relation to the bottom wall.

6. The terminal according to claim 5, wherein said angle of rotation is within a range between about 25 to about 70 degrees.

7. An electrical connection system comprising:

a first connector including at least one receptacle receiving at least one receptacle contact section of at least one terminal, wherein said at least receptacle contact section has a length and includes a top wall and a bottom wall opposite the top wall and is adapted to receive a corresponding at least one mating contact member, said at least one receptacle contact section including, a primary cantilever spring member extending outwardly from a forward portion end of said receptacle contact section and extending from said bottom wall and being bent back into a cavity of the receptacle contact section, said primary member being angularly positioned and having an upper surface facing the top wall and a lower surface opposite the upper surface, the primary member further including an arcuate end, said arcuate end being spaced from said top wall by a distance from the top wall less than a thickness of the at least one mating contact member, and a secondary cantilever spring member being formed from said bottom wall extending into said receptacle contact section and having an arcuate end, said arcuate end of the secondary member having an underlying, spaced relationship with the lower surface of the primary member wherein the arcuate end of the primary member is disposed intermediate the top wall and the secondary member along a height of the at least one receptacle contact section and the arcuate end of the secondary section is disposed between intermediate the forward portion and the arcuate end of the primary member along the length, and a second connector matable to said first connector, the second connector including at least one receptacle receiving said at least one mating contact member, and wherein the lower surface of the primary member remote from the arcuate end of the primary member in the at least one receptacle contact section and the arcuate end of the secondary member in the at least one receptacle contact section define a nonorthogonal gap in relation to the bottom wall, and when the at least one matable contact member is received into the at least one receptacle contact section, the gap closes such that the lower surface of the primary member remote from the arcuate end of the primary member engages the arcuate end of the secondary member, and wherein the gap comprises a distance that allows a difference between a peak engage force and a sliding engage force for the at least one matable contact member when the at least one matable contact member is received into the at least one receptacle contact section to be is at a minimum, and when the matable contact member is fully received into the cavity so as to be mated with the receptacle contact section the acute end of the primary member and the acute end of the secondary member, respectively, do not make contact with the bottom wall.

8. The connection system according to claim 7, wherein when the first connector is mated to the second connector and the at least one matable contact member is received into the at least one receptacle contact section, the arcuate free ends of the spring members, respectively, in the at least one receptacle contact section do not engage.

9. The connection system according to claim 7, wherein the secondary member includes a majority portion intermediate the arcuate end of the secondary member and the bottom wall extending from the bottom wall into the receptacle contact section, and the majority portion has an angle of rotation in relation to the bottom wall.

10. The connection system according to claim 9, wherein the angle of rotation is within a range between about 25 to about 70 degrees.

* * * * *